US008992188B2

(12) United States Patent
Nakamura et al.

(10) Patent No.: US 8,992,188 B2
(45) Date of Patent: Mar. 31, 2015

(54) REVOLUTION TYPE COMPRESSOR

(75) Inventors: Satoshi Nakamura, Shizuoka (JP); Mutsunori Matsunaga, Shizuoka (JP); Takeshi Tsuchiya, Tsuchiura (JP); Masatsugu Chikano, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 640 days.

(21) Appl. No.: 12/637,779

(22) Filed: Dec. 15, 2009

(65) Prior Publication Data

US 2010/0150752 A1 Jun. 17, 2010

(30) Foreign Application Priority Data

Dec. 15, 2008 (JP) ..... 2008-317815

(51) Int. Cl.

| | |
|---|---|
| ***F04B 17/03*** | (2006.01) |
| ***F04B 35/04*** | (2006.01) |
| ***F04C 23/00*** | (2006.01) |
| ***F04C 29/02*** | (2006.01) |
| *F04C 18/02* | (2006.01) |

(52) U.S. Cl.

CPC ..... *F04C 23/008* (2013.01); *F04C 29/028* (2013.01); *F04C 18/0215* (2013.01); *F04C 2240/807* (2013.01)

USPC ..... 417/410.5; 418/151; 418/55.6; 418/55.1

(58) Field of Classification Search

CPC ..... F04C 18/0223; F04C 18/0215; F04C 18/0207; F04C 29/023

USPC ..... 417/410.5; 418/151, 94, 55.1, 55.6

See application file for complete search history.

(56) References Cited

U.S. PATENT DOCUMENTS

| | | | | | |
|---|---|---|---|---|---|
| 4,762,478 | A | * | 8/1988 | Sakurai et al. | 418/55.1 |
| 4,838,773 | A | * | 6/1989 | Noboru | 418/55.5 |
| 4,915,554 | A | * | 4/1990 | Serizawa et al. | 418/94 |
| 4,934,905 | A | * | 6/1990 | Richardson, Jr. | 417/372 |
| 5,007,810 | A | * | 4/1991 | Fraser et al. | 417/410.5 |
| 5,026,262 | A | * | 6/1991 | Baumann et al. | 418/55.6 |
| 5,108,274 | A | * | 4/1992 | Kakuda et al. | 418/55.1 |
| 5,176,506 | A | * | 1/1993 | Siebel | 417/368 |
| 5,230,616 | A | * | 7/1993 | Serizawa et al. | 418/151 |
| 5,336,060 | A | * | 8/1994 | Tomell et al. | 417/410.5 |
| 5,439,361 | A | * | 8/1995 | Reynolds et al. | 418/55.6 |
| 5,476,369 | A | * | 12/1995 | Fowlkes et al. | 417/410.5 |

(Continued)

FOREIGN PATENT DOCUMENTS

| | | |
|---|---|---|
| JP | 2000-73977 | 3/2000 |
| JP | 2001-234863 | 8/2001 |
| JP | 2002-218411 | 8/2001 |

*Primary Examiner* — Alexander Comley

(74) *Attorney, Agent, or Firm* — Baker Botts L.L.P.

(57) ABSTRACT

In a revolution type compressor using a balance weight for balancing a rotating mass, the effect of oil churn reduction is enhanced, and compressor input is reduced. A balance weight fixed to a drive shaft between a rotor of an electric motor 4 and a compression mechanism includes a weight portion in a substantially semicircular column shape for balancing a rotating mass, a cover portion which is substantially semi-cylindrical and has an opening in the vicinity of a top and bottom at an opposite side in a radial direction from the weight portion, and a hollow space surrounded by the weight portion and the cover portion. Further, a space for discharging oil is provided between the balance weight and the rotor. By the structure, reduction in oil churn, and reduction in input of the compressor are realized, and the compressor with less power consumption is obtained.

9 Claims, 16 Drawing Sheets

(56) References Cited

U.S. PATENT DOCUMENTS

| | | | | |
|---|---|---|---|---|
| 5,597,293 | A * | 1/1997 | Bushnell et al. | 417/410.3 |
| 6,135,738 | A * | 10/2000 | Kajiwara et al. | 418/55.4 |
| 6,174,149 | B1 * | 1/2001 | Bush | 418/55.1 |
| 6,231,317 | B1 * | 5/2001 | Watanabe et al. | 417/410.5 |
| 6,247,907 | B1 * | 6/2001 | Williams et al. | 417/410.5 |
| 6,291,920 | B1 * | 9/2001 | Miller et al. | 310/261.1 |
| 6,305,914 | B1 * | 10/2001 | Lifson | 417/410.5 |
| 6,418,902 | B1 * | 7/2002 | Ericson | 123/192.2 |
| 6,682,323 | B2 * | 1/2004 | Milliff et al. | 417/410.5 |
| 6,860,729 | B2 * | 3/2005 | Sowa et al. | 418/151 |
| 7,162,797 | B2 * | 1/2007 | Sowa et al. | 29/888.022 |
| 7,384,250 | B2 * | 6/2008 | Shin et al. | 418/55.6 |
| 7,393,191 | B2 * | 7/2008 | Morozumi et al. | 418/101 |
| 7,413,423 | B2 * | 8/2008 | Bonifas | 418/55.6 |
| 7,435,067 | B2 * | 10/2008 | Doepker et al. | 418/151 |
| 2004/0179967 | A1 * | 9/2004 | Morozumi et al. | 418/55.1 |
| 2005/0180871 | A1 * | 8/2005 | Ohtahara et al. | 417/502 |
| 2006/0127262 | A1 * | 6/2006 | Shin et al. | 418/55.6 |
| 2008/0292484 | A1 * | 11/2008 | Suh et al. | 418/55.3 |
| 2008/0304994 | A1 * | 12/2008 | Ohtahara et al. | 418/55.1 |

* cited by examiner

REVOLUTION TYPE COMPRESSOR

BACKGROUND OF THE INVENTION

The present invention relates to a revolution type compressor which is constructed by housing a compression mechanism for compressing a refrigerant, a drive shaft for driving the compression mechanism, and an electric motor for rotating the drive shaft in a hermetically sealed chamber, and fixedly providing a balance weight for balancing a rotating mass of the aforementioned compression mechanism at the aforementioned drive shaft.

As the conventional revolution type compressor, there are known the ones each constructed by housing a compression mechanism for compressing a refrigerant, a drive shaft for driving the compression mechanism, and an electric motor for revolving the drive shaft in a hermetically sealed chamber (hermetically sealed container), as described in JP-A-2001-218411, JP-A-2001-234863 and JP-A-2000-73977, and the aforementioned electric motor includes a stator fixed to the hermetically sealed container, and a rotor connected to a drive part. Further, a balance weight for balancing the rotating mass of the aforementioned compression mechanism is disposed at the aforementioned drive shaft, and the balance weight is constructed into a cylindrical shape by a weight part in a substantially semicircular column shape for balancing the rotating mass, and a substantially semi-cylindrical cover part provided at an opposite side in the radial direction from the weight part. It is known that the cylindrical balance weight prevents agitation of the refrigerant to suppress oil churn.

BRIEF SUMMARY OF THE INVENTION

A structure example of the compressor in the above described prior art is shown in FIG. 2. By forming the balance weight into the shape as in FIG. 2, churn of the refrigerant by the balance weight can be prevented and oil scattering reduction effect is obtained, as compared with the conventional structure illustrated in FIG. 3(A) of JP-A-2000-73977. However, as shown in FIG. 2, part of the oil supplied to a main bearing 18 accumulates in an inside 90*a* of a cylindrical balance weight 90, the oil accumulating in the inside 90*a* of the balance weight revolves with the balance weight, and therefore, input of the compressor is increased. Further, oil overflows from the inside of the balance weight and scatters in the radial direction by the centrifugal force of the balance weight, and flows out to the outside of the compressor from a discharge pipe 102 without dropping into an oil sump 103 at the lower portion of the compressor. The oil flowing out to the outside of the compressor adheres to the inside of the heat exchanger constructed by the refrigeration cycle, and reduces the heat exchange efficiency to decrease performance of the refrigeration cycle.

Further, as described in JP-A-2001-234863, it is known that a rotor and a cylindrical balance weight are constructed to be an integrated piece, an oil discharge hole penetrating in the axial direction is provided inside the rotor so that oil does not accumulate inside the cylindrical balance weight. However, oil has to be discharged downward and perpendicularly to the direction of the centrifugal force by the rotor, and oil discharge performance is low. Further, in the one in the cited document 2, the rotor in which the permanent magnet is disposed, and the balance weight which is a magnetic substance are integrated, and therefore, there is the disadvantage that the magnetic flux of the rotor leaks to reduce the efficiency of the electric motor, and increases the input of the compressor.

An object of the present invention is to enhance the effect of reducing oil churn, and to reduce input power of a compressor in a revolution type compressor including a balance weight for balancing a rotating mass.

According to the invention for achieving the object, a revolution type compressor for compressing a refrigerant, comprises: a compressing mechanism for compressing the refrigerant, a drive shaft for driving the compressing mechanism, an electric motor for rotating the drive shaft, a hermetically sealed container containing the compressing mechanism, the drive shaft and the electric motor, and a balance weight arranged on the drive shaft to be balanced in rotating mass with the compressing mechanism, the electric motor including a stator fixed to the container and a rotor connected to the drive shaft, wherein the balance weight has a weight portion of semicircular column shape for balancing the balance weight and the compressing mechanism in rotating mass with each other, a cover portion of semi-cylindrical shape being opposite radially to the weight portion and including openings arranged at its lower and upper areas respectively, and a hollow space surrounded by the weight portion and the cover portion, and the balance weight and the rotor are distant from each other to form an axial clearance therebetween.

The compressor may further comprise a positioning member arranged in the axial clearance and prevented from extending to close the opening at the lower area of the cover portion. The positioning member may have a fluidal path communicating fluidly with the opening at the lower area of the cover portion. Further, the rotor may have another fluidal path to communicate fluidly with the fluidal path at an axial end surface of the rotor facing to the positioning member.

As another aspect of the invention, a revolution type compressor for compressing a refrigerant, comprises: a compressing mechanism for compressing the refrigerant, a drive shaft for driving the compressing mechanism, an electric motor for rotating the drive shaft, a hermetically sealed container containing the compressing mechanism, the drive shaft and the electric motor, and a balance weight arranged on the drive shaft to be balanced in rotating mass with the compressing mechanism, the electric motor including a stator fixed to the container and a rotor connected to the drive shaft, wherein the balance weight has a weight portion of semicircular column shape for balancing the balance weight and the compressing mechanism in rotating mass with each other, a cover portion of semi-cylindrical shape being opposite radially to the weight portion and including openings arranged at its lower and upper areas respectively, and a hollow space surrounded by the weight portion and the cover portion, and the compressor further comprises a positioning member arranged between the balance weight and the rotor, and prevented from extending to close the opening at the lower area of the cover portion.

As the other aspect of the inventions, a revolution type compressor for compressing a refrigerant, comprises: a compressing mechanism for compressing the refrigerant, a drive shaft for driving the compressing mechanism, an electric motor for rotating the drive shaft, a hermetically sealed container containing the compressing mechanism, the drive shaft and the electric motor, and a balance weight arranged on the drive shaft to be balanced in rotating mass with the compressing mechanism, the electric motor including a stator fixed to the container and a rotor connected to the drive shaft, wherein the balance weight has a weight portion of semicircular column shape for balancing the balance weight and the compressing mechanism in rotating mass with each other, a cover portion of semi-cylindrical shape being opposite radially to the weight portion and including openings arranged at its lower and upper areas respectively, a hollow space surrounded by the weight portion and the cover portion, and a protruding portion extending toward the rotor from the vicinity of the opening at the lower area and contacting the rotor.

The rotor may include permanent magnets. It is preferable for the rotor to include permanent magnets, while the positioning member is made of non-magnetic material.

When the rotor includes permanent magnets, it is preferable for the positioning member to have an outer peripheral diameter less than an inscribed circle diameter of the permanent magnets.

It is preferable that the rotor includes permanent magnets, and an outer peripheral diameter of the protruding portion is less than an inscribed circle diameter of the permanent magnets.

It is preferable that the balance weight is made of magnetic material such as iron or the like.

By constructing the balance weight as described above, in the one in which a clearance is provided in the axial direction of the balance weight and the rotor, the oil which drops to the inside of the balance weight can be discharged to the outer periphery of the upper portion of the rotor through the clearance.

More specifically, the oil which drops to the inside of the balance weight is discharged to the space in the upper portion of the rotor without accumulating inside the balance weight, is further discharged to the outer periphery of the rotor by the action of the centrifugal force of the rotor, and is returned to the oil sump provided at the lower portion of the compressor through the clearance provided between the inside of the hermetically sealed container and the stator. Thereby, input of the compressor reduces, and the compressor with less power consumption can be obtained. Further, the oil which flows outside the compressor can be decreased, and the performance of the refrigeration cycle can be enhanced by reducing oil churn.

Further, in the case of use of the electric motor of the structure in which a permanent magnet is placed inside the rotor, leakage of the magnetic fluxes of the rotor can be reduced. Therefore, there is provided the effect of securing the electric motor efficiency and preventing increase in input of the compressor.

Other objects, features and advantages of the invention will become apparent from the following description of the embodiments of the invention taken in conjunction with the accompanying drawings.

BRIEF DESCRIPTION OF THE SEVERAL VIEWS OF THE DRAWINGS

FIG. 6A is a vertical sectional view, and FIG. 6B is a plane view;

FIG. 8A is a vertical sectional view, and FIG. 8B is a plane view;

FIG. 10A is a vertical sectional view, and FIG. 10B is a plane view;

FIG. 11A is a plane view, and FIG. 11B is a vertical sectional view;

FIG. 13A is a vertical sectional view thereof, and FIG. 13B is a plane view thereof;

FIG. 15A is a vertical sectional view thereof, and FIG. 15B is a plane view thereof; FIG. 16A is a plane view thereof, and FIG. 16B is a vertical sectional view thereof.

DETAILED DESCRIPTION OF THE INVENTION

Hereinafter, an example of the present invention will be described based on the drawings.

EXAMPLE 1

Figure 1:
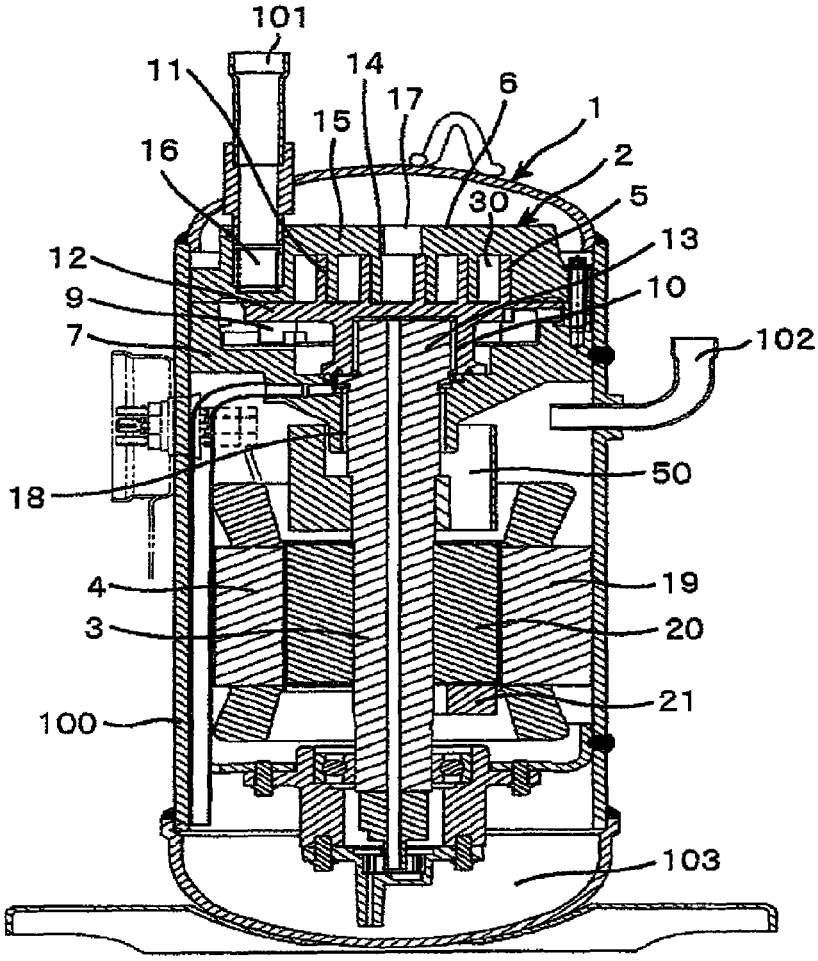
FIG. 1 is a vertical sectional view showing example 1 of a revolution type compressor of the present invention.
Figure 2:
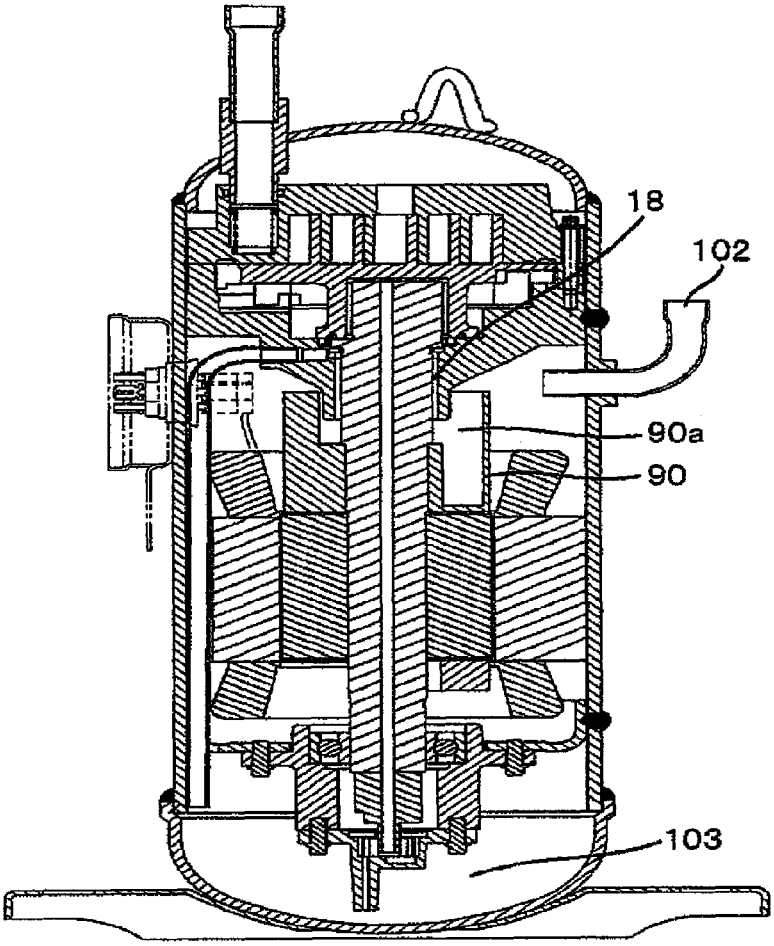
FIG.2 PRIOR ART
FIG. 2 is a vertical sectional view of a conventional revolution type compressor.

FIG. 1 shows example 1 of a revolution type compressor of the present invention, and is a general structural view of the case of being applied to a scroll compressor. A scroll compressor 1 is constructed by housing a compression mechanism 2, a drive shaft 3 and an electric motor 4 in a hermetically sealed container 100, and is of a vertical structure in which the compression mechanism 2 and the electric motor 4 are vertically arranged. The compression mechanism 2 includes an orbiting scroll 5, a fixed scroll 6, a frame 7, a drive shaft 3, a bearing 10 for orbiting scroll and an orbiting mechanism 9. Further, the compression mechanism 2 forms a compressor area 30 by combining the fixed scroll 6 and the orbiting scroll 5, and the aforementioned orbiting scroll 5 includes a spiral wrap 11 and an end plate 12. At the rear surface side of the end plate 12 of the orbiting scroll 5, the orbiting mechanism 9 which is constructed by an Oldham ring or the like is provided, and the bearing 10 for orbiting scroll in which a crankshaft 13 of the drive shaft 3 is inserted is provided. The fixed scroll 6 includes a spiral wrap 14, an end plate 15, a suction port 16 and a discharge port 17, and is fixed to the frame 7 via a bolt. By the above described construction, the aforementioned orbiting scroll 5 is sandwiched between the fixed scroll 6 and the frame 7 to be capable of orbiting movement.

A suction pipe 101 provided at the hermetically sealed container 100 is connected to the suction port 16 of the fixed scroll 6. Further, a discharge pipe 102 is provided at the hermetically sealed container 100 so as to communicate with a space between the frame 7 and the electric motor 4. The frame 7 has its outer peripheral portion fixed to the hermetically sealed container 100, and a main bearing 18 is provided in its central portion between the electric motor 4 and the orbiting scroll 5. The drive shaft 3 has the crankshaft 13 at the upper portion of the main bearing, and drives the orbiting scroll 5 by inserting and engaging the crankshaft 13 in the bearing 10 for orbiting scroll provided at the rear surface of the orbiting scroll 5.

The electric motor 4 constructs revolution drive means for driving the compression mechanism 2 via the drive shaft 3, and has a stator 19 and a rotor 20 as basic elements. The outer peripheral surface of the stator 19 is fixed to be substantially in close contact with the inner peripheral surface of the hermetically sealed container 100. When the drive shaft 3 is rotated by the rotation of the electric motor 4, the orbiting scroll 5 performs orbiting movement with respect to the fixed scroll 6 while keeping the posture by the function of the orbiting mechanism 9. In order to cancel the unbalanced force which occurs due to its orbiting movement, a balance weight 50 which is fixed to the drive shaft between the rotor 20 and the orbiting scroll 5, and a rotor balance weight 21 which is fixed to the lower portion of the rotor 20, are provided.

In the compressor area 30 which is formed by meshing of the fixed scroll 6 and the orbiting scroll 5, a compression operation with its volumetric capacity decreasing is performed by orbiting movement of the orbiting scroll 5. In the compression operation, an operating fluid is sucked into the compressor area 30 from the suction port 16 with the orbiting movement of the orbiting scroll 5, the sucked operating fluid is discharged to the discharge space in the hermetically sealed container 100 from the discharge port 17 of the fixed scroll 6 through the compression stroke, thereafter, flows into the space where the electric motor 4 is arranged, and is further discharged outside the hermetically sealed container 100 through the discharge pipe 102. Thereby, the space in the hermetically sealed container 100 is kept at a discharge pressure.

Figure 3A:
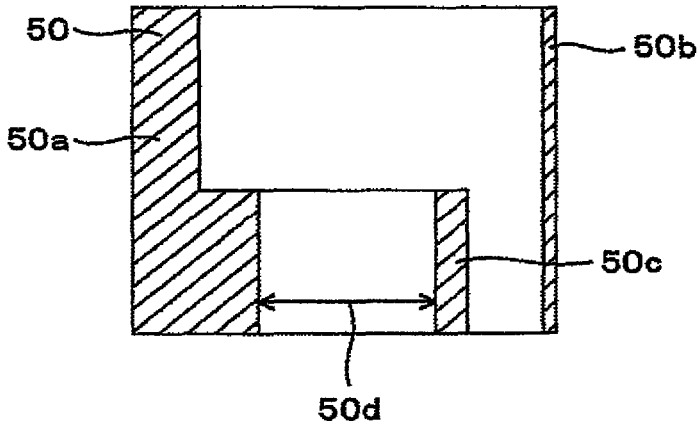
FIG. 3A is a vertical sectional view showing a balance weight shown in FIG. 1 by enlarging it and FIG. 3B is a plane view of the same.
Figure 3B:
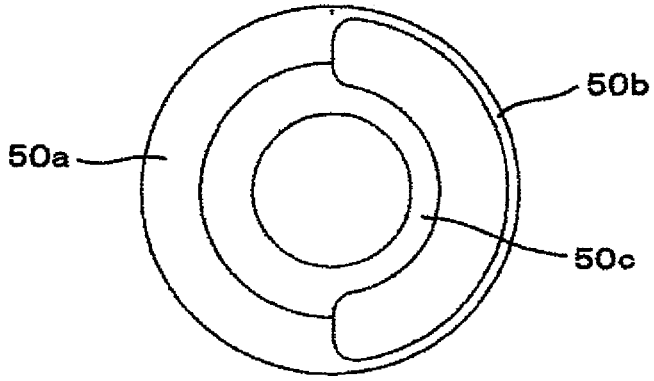

FIG. 3A is a vertical sectional view and FIG. 3B is a plane view each showing the balance weight 50 shown in FIG. 1 by enlarging it. The balance weight 50 is constructed by a weight portion 50*a*, a cover portion 50*b* and a boss portion 50*c*. The upper and lower end surfaces of the balance weight are opened to communicate with an upper space and a lower space of the balance weight. Therefore, the balance weight is of the structure in which oil does not accumulate inside the balance weight.

In the case of adoption of a cylindrical balance weight using a non-magnetic substance other than iron, for example, zinc, as the material of the balance weight, the density is smaller by about 10 to 15% as compared with iron and the like, and therefore, the volume of the balance weight needs to be larger by 10 to 15% as compared with the balance weight of iron or the like, and reduction in size and weight of the compressor becomes difficult. In the case of use of copper with a large density as the material of the balance weight, reduction in size and weight of the compressor is possible, but the material unit price becomes high as compared with iron, and the cost of the compressor increases.

Further, in the case of an ordinary compressor having a large number of components using iron, if the balance weight is constructed by a material other than iron, troubles due to difference in the material characteristic easily occur. For example, when the thermal expansion coefficient differs significantly, the deformation amount differs before and during operation, and therefore, the fastening margins and clearances of the components before and during operation differ, which becomes the constraint in design. In order to attain reduction in size, weight and cost of the compressor in such a background as well as to minimize design restrictions, adoption of the balance weight of iron is preferable.

Figure 4:
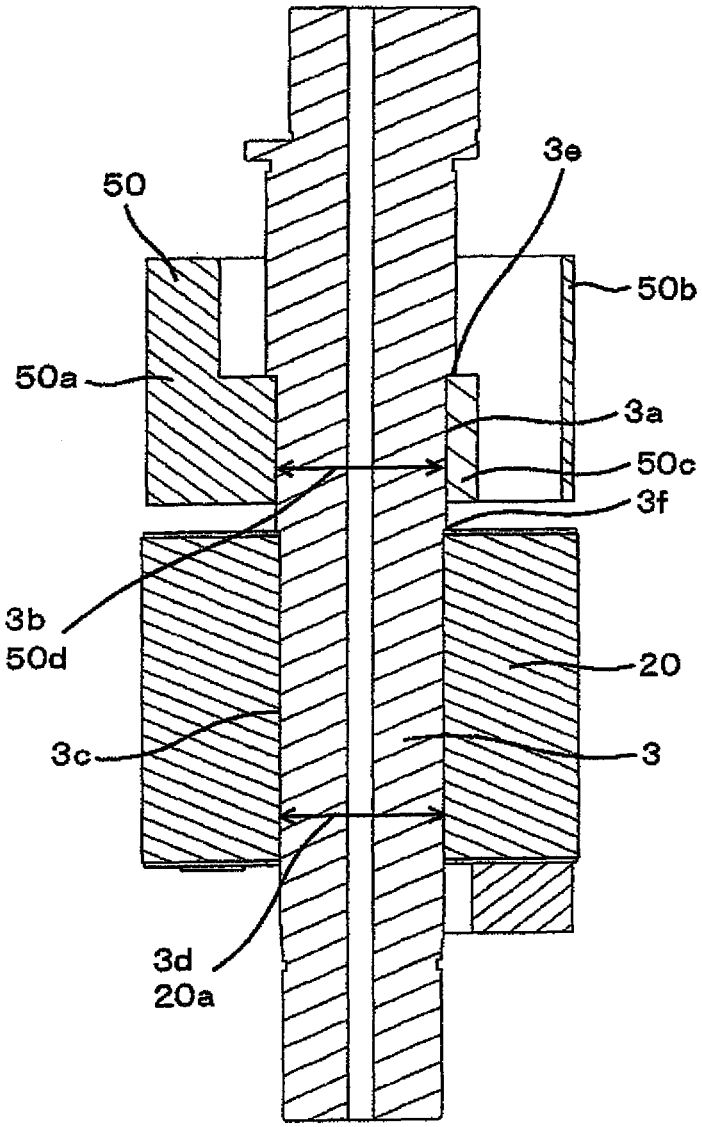
FIG. 4 is a sectional view showing arrangement relationship of the balance weight and a rotor which are fixed to a drive shaft in the example shown in FIG. 1.

FIG. 4 is a sectional view showing the arrangement relationship of the balance weight 50 and the rotor 20 which are fixed to the drive shaft 3. An inside diameter 50*d* of the boss portion 50*c* of the balance weight 50 is made to be smaller than a hold part outside diameter 3*b* of a balance weight hold part 3*a* of the drive shaft 3, and the boss portion 50*c* of the balance weight 50 is fastened to the balance weight hold part 3*a* of the drive shaft 3 by press fitting or shrink fitting. A stepped portion 3*e* is provided at the drive shaft 3, and the balance weight 50 is fixed to the drive shaft 3 in the state in close contact with the stepped portion.

An inside diameter 20*a* of the rotor 20 is made to be smaller than a hold part outside diameter 3*d* of a rotor hold part 3*c* of the drive shaft 3, and the rotor 20 is fastened to the drive shaft 3 by press fitting or shrink fitting. A stepped portion 3*f* is formed at the drive shaft 3, and the rotor 20 is fixed to the drive shaft 3 in the state in close contact with the stepped portion 3*f*. The stepped portion 3*f* is provided at the side of the rotor 20 from the lower end surface of the boss portion 50*c* of the balance weight 50, and the rotor 20 is positioned by the stepped portion 3*f*, whereby a clearance can be formed between the rotor 20 and the balance weight 50.

With the above described structure, by arranging the rotor and the balance weight, the oil which drops inside the balance weight can be allowed to flow out to the lower portion of the balance weight without accumulating inside the balance weight.

Figure 5:
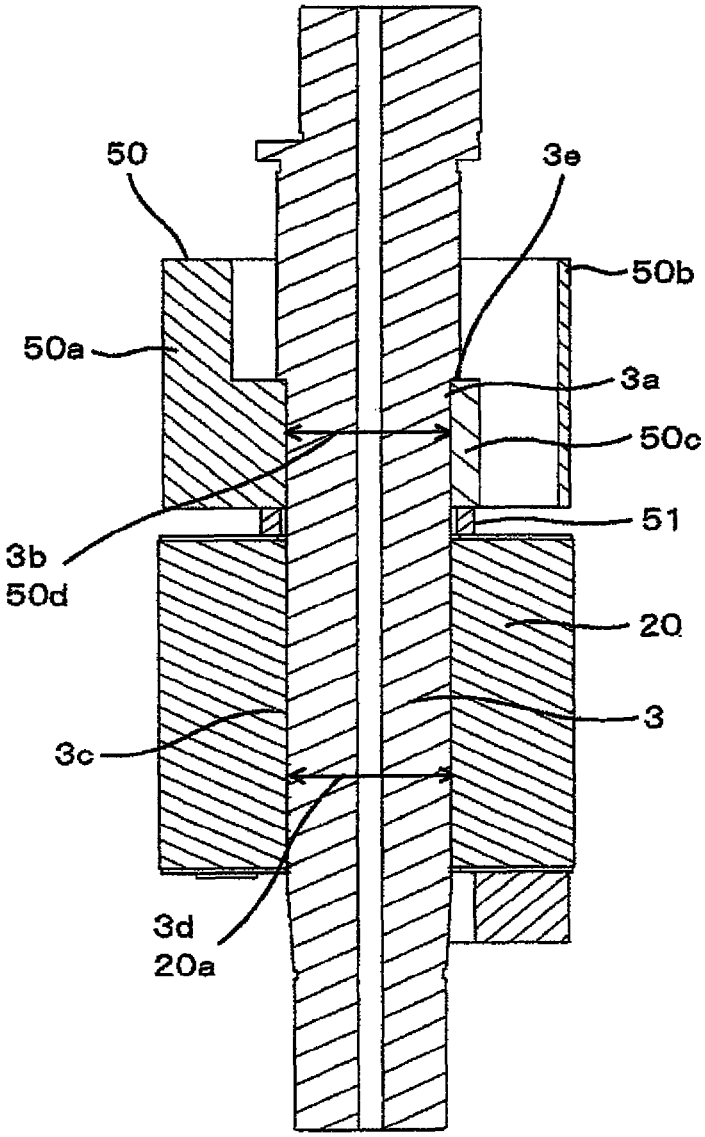
FIG. 5 is a view showing a modified example of FIG. 4, and is a view corresponding to FIG. 4.

FIG. 5 is a view showing a modified example of FIG. 4, and is a view corresponding to FIG. 4. The structure of the balance weight itself is the same as that shown in FIGS. 3 and 4. Fastening of the balance weight 50 and the rotor 20 to the drive shaft 3 is performed by fastening the balance weight 50 and the rotor 20 to the drive shaft 3 by press fitting or shrink fitting as in the case of FIG. 4. In this example, in order to positioning the rotor in the axial direction, a positioning member 51 is used. More specifically, the rotor is fastened to the drive shaft by press fitting or shrink fitting so that the positioning member 51 is sandwiched with the balance weight and the rotor. In this case, the balance weight hold part 3*a* and the rotor hold part 3*c* of the drive shaft 3 can have the same diameters, and work of the drive shaft becomes easy.

Figure 6A:
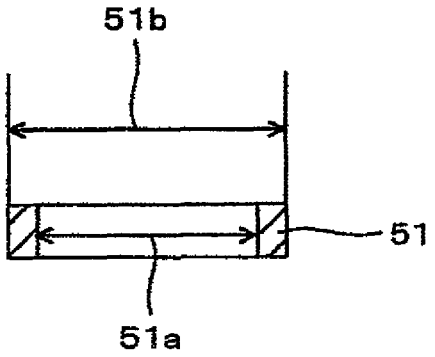
FIGS. 6A and 6B are views showing a positioning member shown in FIG. 5 by enlarging it.
Figure 6B:
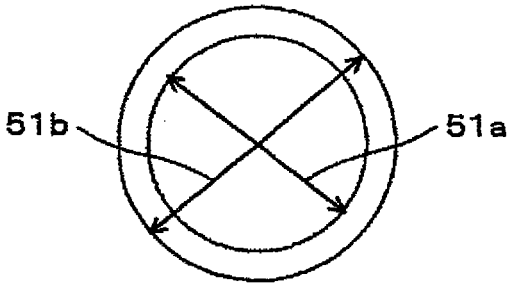

FIGS. 6A and 6B are views showing the positioning member 51 shown in FIG. 5 by enlarging it, FIG. 6A is a vertical sectional view, and FIG. 6B is a plane view. An inside diameter 51*a* of the positioning member 51 is a little larger than the hold part outside diameter 3*d* of the drive shaft 3, and an outside diameter 51*b* of the positioning member 51 is set to be such a dimension as not to close the opening of the lower portion of the cover portion 50*b* of the balance weight 50.

By using the positioning member in such a shape, the oil which drops inside the balance weight can be caused to flow out to the outer peripheral side of the upper portion of the rotor through the passage formed between the rotor and the lower end of the balance weight by the positioning member 51.

Figure 7:
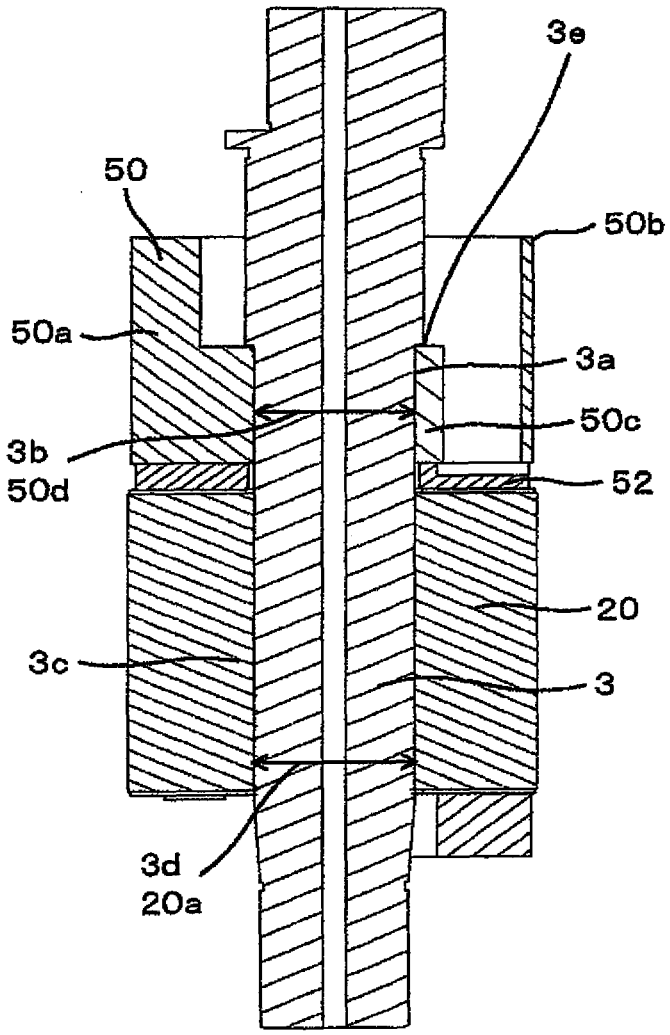
FIG. 7 is a view showing another modified example of FIG. 4, and is a view corresponding to FIG. 4.

FIG. 7 is a view showing still another modified example of FIG. 4, and is a view corresponding to FIG. 4. In this modified example, the shape of the balance weight is the same as that shown in FIGS. 3A and 3B and 4. Further, fastening of the balance weight 50 and the rotor 20 to the drive shaft 3 is the same as that in the example of FIG. 4. Further, as in the example of FIG. 5, a positioning member 52 is provided, and fastening of it to the drive shaft is similar to the example of FIG. 5. The point in which the modified example differs from the example of FIG. 5 is the shape of the positioning member 52.

Figure 8A:
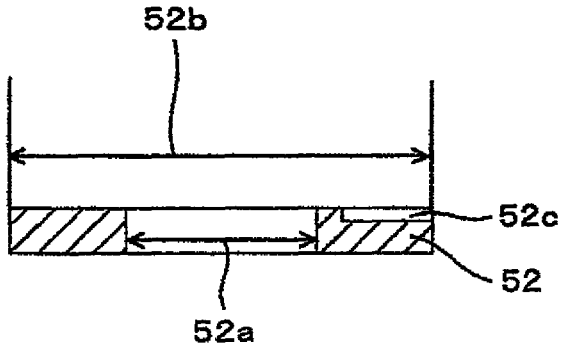
FIGS. 8A and 8B are enlarged views of the positioning member shown in FIG. 7.
Figure 8B:
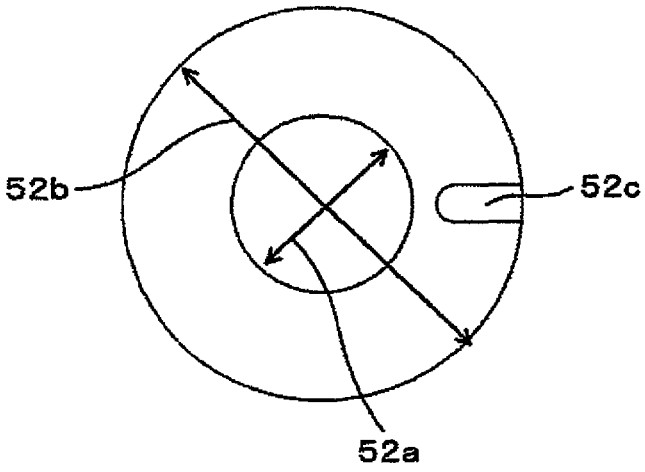

FIGS. 8A and 8B are enlarged views of the positioning member 52 shown in FIG. 7, FIG. 8A is a vertical sectional view, and FIG. 8B is a plane view. As in the example shown in FIG. 6, an inside diameter 52*a* of the positioning member 52 is constructed to be a little larger than the hold part outside diameter 3*d* of the drive shaft 3, but in this example, an outside diameter 52*b* of the positioning member 52 is constructed to be substantially the same size as the outside diameter 20*b* of the rotor 20. Further, a channel (passage of the positing member) 52*c* in the radial direction is formed in the outer peripheral side of the positioning member 52, and the passage 52*c* communicates with the opening at the lower end of the cover portion 50*b* of the balance weight 50, and the outer peripheral side end of the passage 52*c* of the positioning member opens to the outer peripheral side of the positioning member 52.

By such a construction, the oil which drops inside the balance weight is caused to flow out to the outer peripheral side of the upper portion of the rotor through the passage formed by the aforementioned channel.

Figure 9:
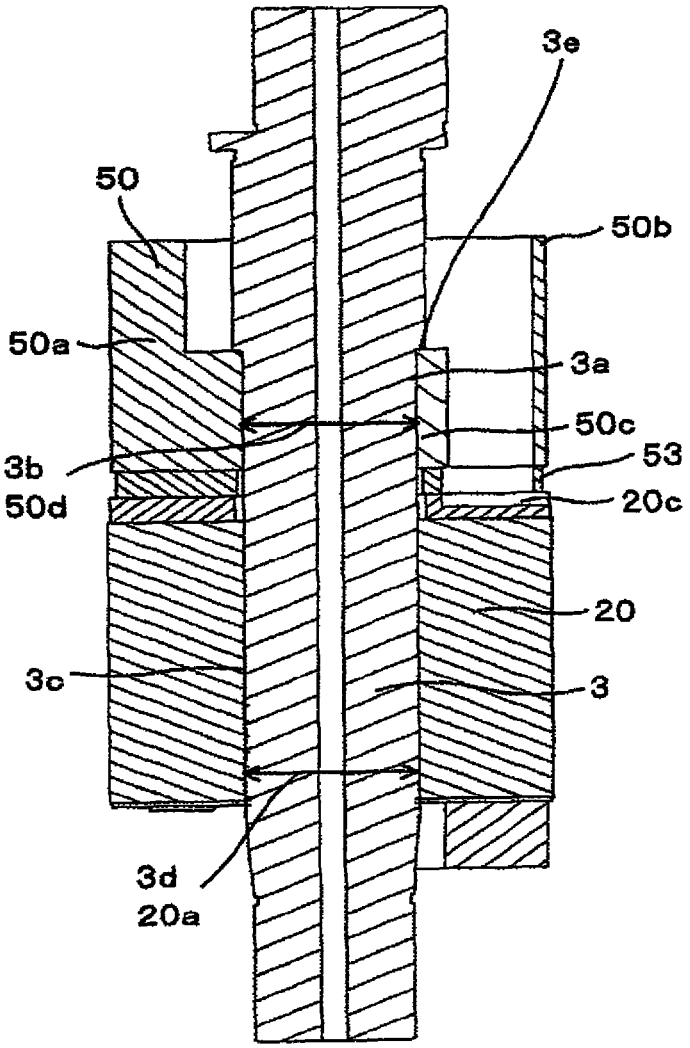
FIG. 9 is a view showing still another modified example of FIG. 4, and is a view corresponding to FIG. 4.

FIG. 9 is a view showing still another modified example of FIG. 4, and is a view corresponding to FIG. 4. In this modified example, the shape of the balance weight is the same as that shown in FIGS. 3A and 3B, and 4, and fastening of the balance weight 50 and the rotor 20 to the drive shaft 3 is the same as in the example of FIG. 4. Further, as in the examples of FIGS. 5 and 7, a positioning member 53 is provided, and fastening of the positioning member 53 to the drive shaft 3 is the same as in the example of FIG. 5. The point in which the modified example differs from the example of FIG. 5 is the shape of the positioning member 53.

Figure 10A:
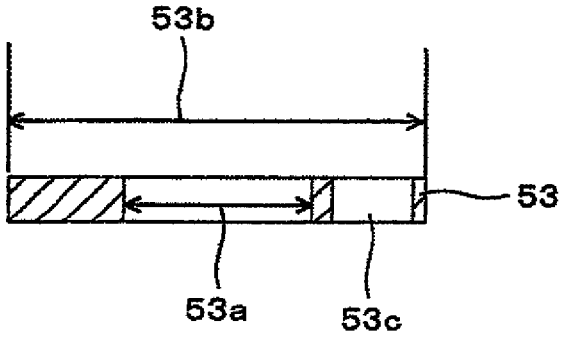
FIGS. 10A and 10B are enlarged views of the positioning member shown in FIG. 9.
Figure 10B:
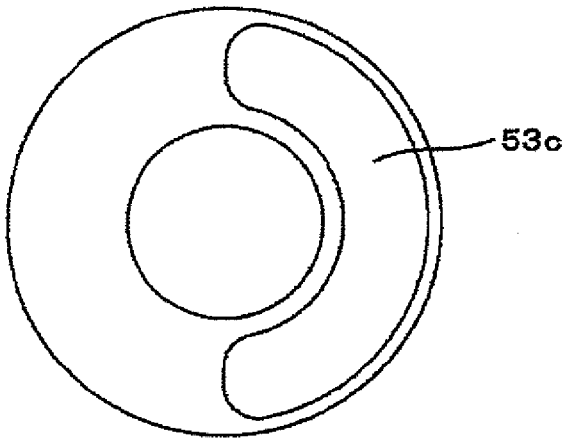

FIGS. 10A and 10B are enlarged views of the positioning member 53 shown in FIG. 9, FIG. 10A is a vertical sectional view, and FIG. 10B is a plane view. Further, FIGS. 11A and 11B are enlarged views of the rotor 20 shown in FIG. 9, FIG. 11A is a plane view, and FIG. 11B is a vertical sectional view.

An inside diameter 53*a* of the positioning member 53 is a little larger than the hold part outside diameter 3*b* of the drive shaft 3, and an outside diameter 53*b* of the positioning member 53 is equivalent to the outside diameter 20*b* of the rotor 20. A hole (passage or space of the positioning member) 53*c* in the circumferential direction is formed in the positioning member 53 to communicate with the opening at the lower end of the cover portion 50*b* of the balance weight 50. Reference numeral and character 20*a* denotes an inside diameter of the rotor 20.

Figure 11A:
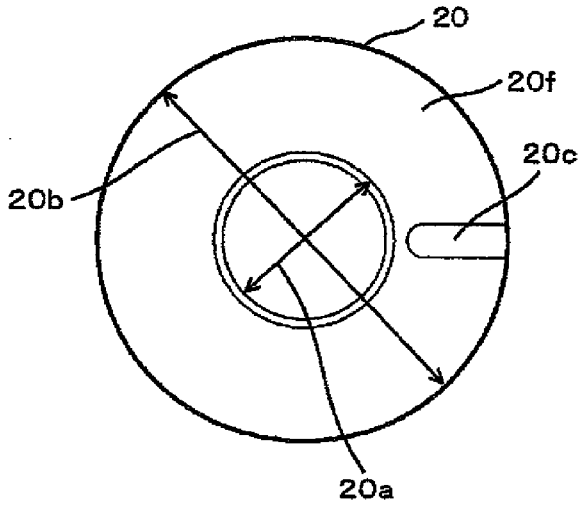
FIGS. 11A and 11B are enlarged views of a rotor shown in FIG. 9.
Figure 11B:
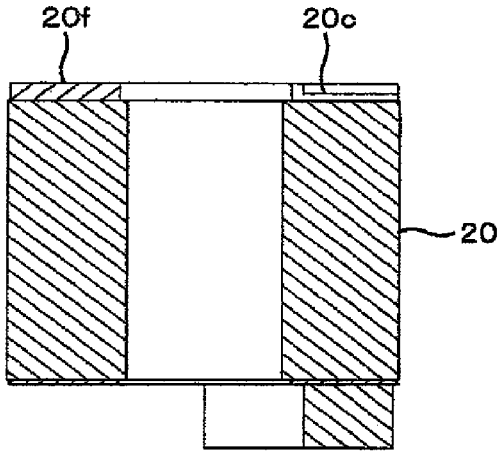

Further, as shown in FIGS. 11A and 11B, a disk-shaped member 20*f* is provided at an upper end surface of the rotor 20, and a channel 20*c* in the radial direction which communicates with the passage 53*c* of the positioning member and opens to the outer peripheral side is formed at the outer peripheral side of the disk-shaped member 20*f*. By adopting such a construction, the oil which drops inside the balance weight is caused to flow out to the outer peripheral side of the upper portion of the rotor from the opening at the lower end of the cover portion 50*b* of the balance weight 50 through the passage 53*c* of the positioning member and the channel 20*c* of the disk-shaped member provided at the upper end surface of the rotor.

Figure 12:
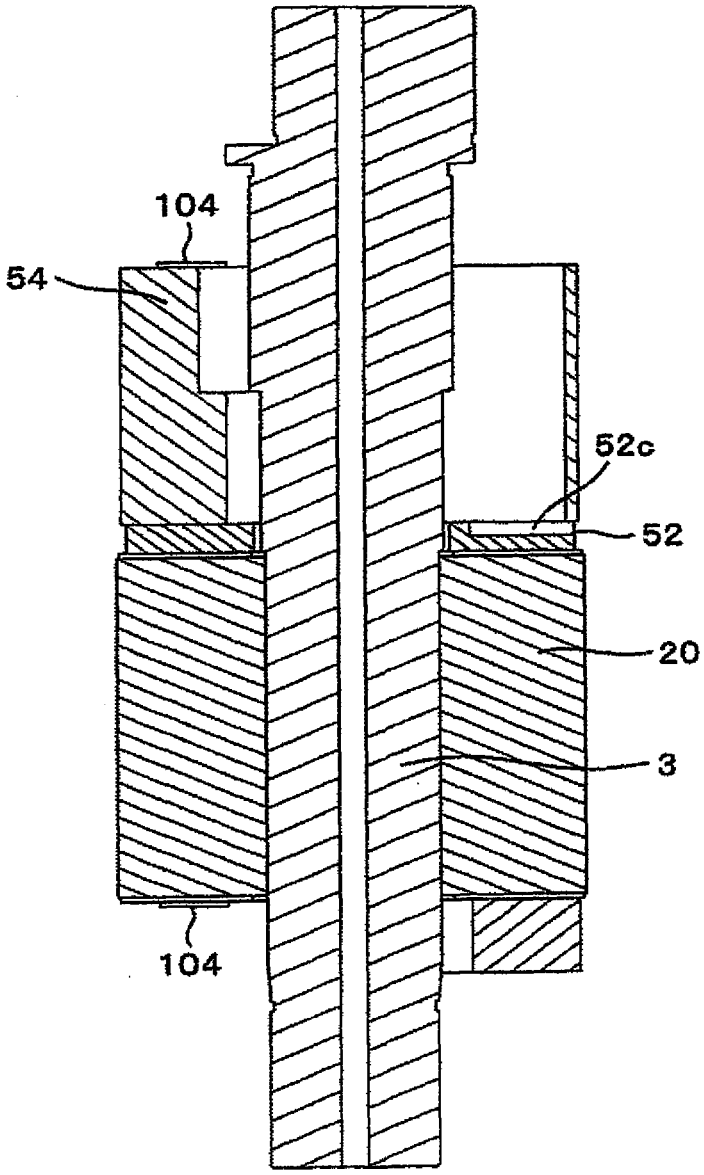
FIG. 12 is a view showing still another modified example of FIG. 4, and is a view corresponding to FIG. 4.

FIG. 12 is a view showing still another modified example of FIG. 4, and is a view corresponding to FIG. 4. Fastening of the rotor 20 to the drive shaft 3 is the same as in the example of FIG. 4. Further, in this example, a balance weight 54 and the positioning member 52 are fixed to the rotor 20 by using a caulked pin 104 which penetrates through the rotor 20, the positioning member 52 and the balance weight 54 and by caulking the end portions of the caulked pin 104. The structure of the aforementioned positioning member 52 includes a passage 52*c* in the radial direction of the positioning member, and the opening at the lower portion of the aforementioned cover portion of the balance weight is not closed, as in the positioning member 52 shown in FIGS. 7, and 8A and 8B.

Figure 13A:
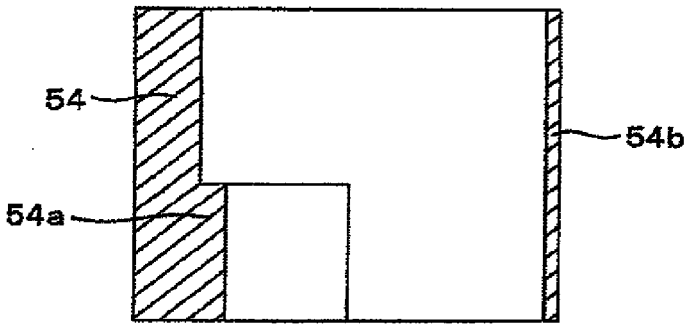
FIGS. 13A and 13B are views showing the details of a balance weight shown in FIG. 12.
Figure 13B:
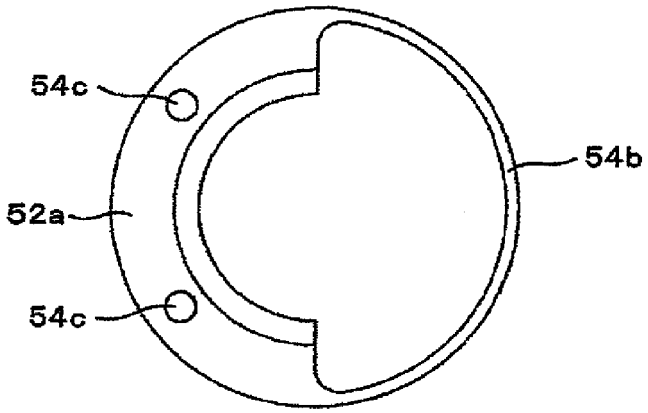

FIGS. 13A and 13B are views showing the details of the balance weight 54 shown in FIG. 12, FIG. 13A is a vertical sectional view of it, and FIG. 13B is a plane view. In this example, the balance weight is constructed by a weight portion 54*a* in a substantially semicircular column shape for balancing the rotating mass, and a cover portion 54*b* in a substantially semi-cylindrical shape having an opening in the vicinity of upper and lower portions, at the opposite side in the radial direction from the weight portion, and the inside of the balance weight is a hollow space surrounded by the aforementioned weight portion and the cover portion. Reference numeral and character 54*c* denotes a through-hole for a caulked pin 104 to penetrate through.

Figure 14:
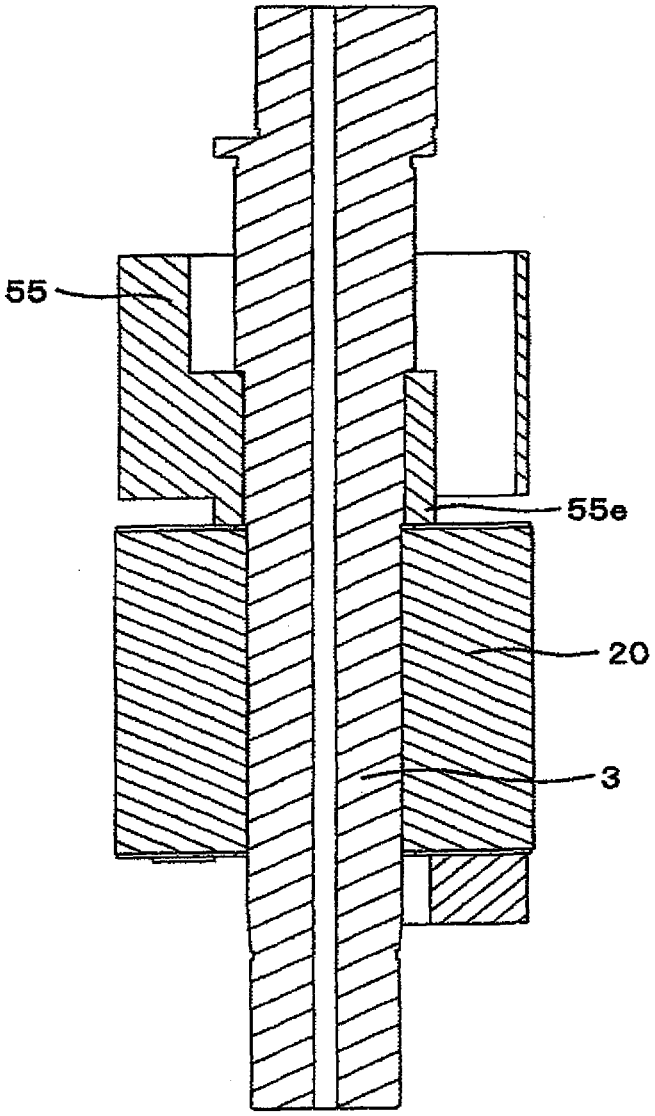
FIG. 14 is a view showing yet another modified example of FIG. 4, and is a view corresponding to FIG. 4.

FIG. 14 is a view showing still another modified example of FIG. 4, and is a view corresponding to FIG. 4. Fastening of a balance weight 55 and the rotor 20 to the drive shaft 3 is the same as in the example of FIG. 4.

Figure 15A:
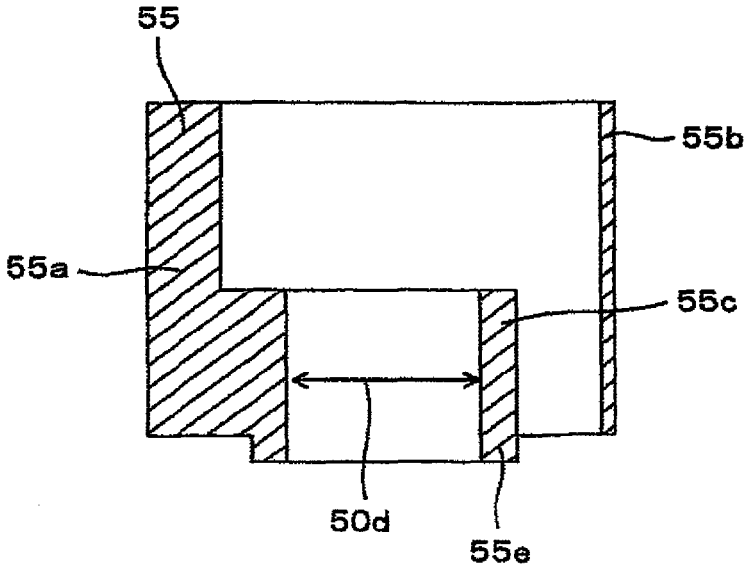
FIGS. 15A and 15B are views showing the details of the balance weight shown in FIG. 14.
Figure 15B:
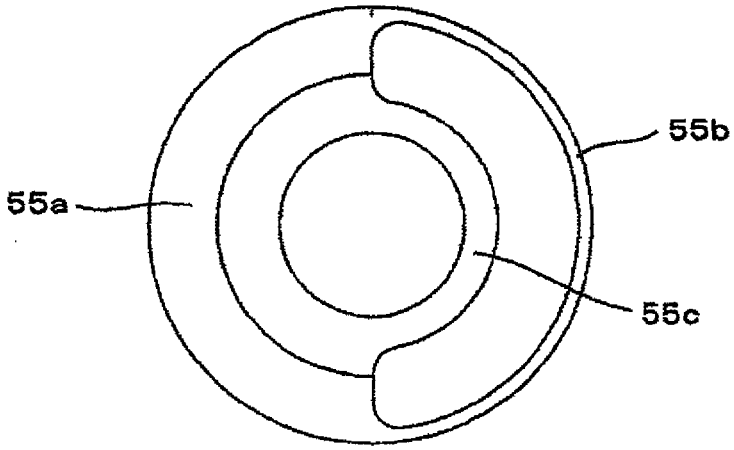

FIGS. 15A and 15B are views showing the details of the balance weight 55 shown in FIG. 14, FIG. 15A is a vertical sectional view of it, and FIG. 15B is a plane view. In this example, the balance weight is constructed by a weight portion 55*a* in a substantially semicircular column shape for balancing the rotating mass, and a cover portion 55*b* in a substantially semi-cylindrical shape having an opening in the vicinity of the upper and lower sides, at the opposite side in the radial direction from the weight portion, and the inside of the balance weight is a hollow space surrounded by the aforementioned weight portion and the cover portion.

In this example, a projecting portion 55*e* which projects to the rotor 20 side from the lower end portion of a boss portion 55*c* of the balance weight is provided integrally with the boss portion without providing the positioning member as shown in FIG. 5, and the projecting portion 55*e* is brought into contact with the upper end portion of the aforementioned rotor 20, whereby the balance weight 55 is positioned.

As the electric motor described in the above described example, a permanent magnet synchronous motor (DC brushless motor) in which a permanent magnet is provided at the rotor 20, a self excitation synchronous motor which includes a cage conductor and a permanent magnet in the rotor and is capable of self excitation without using an inverter and the like can be used in addition to an induction motor having the rotor 20 having a cage conductor.

Figure 16A:
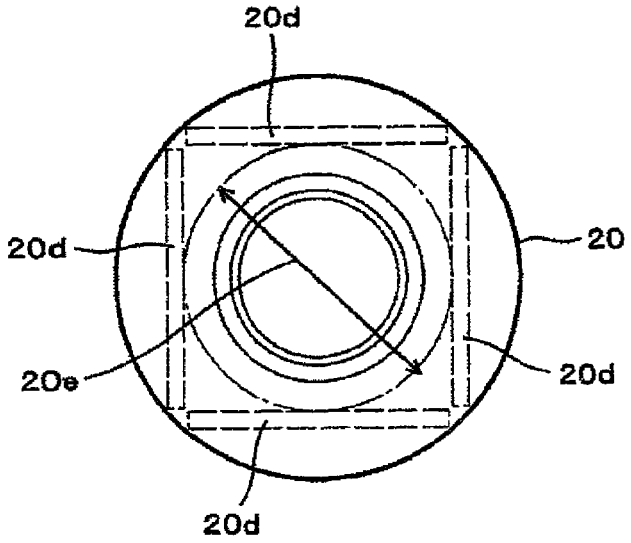
FIGS. 16A and 16B show a structure example of a rotor of a permanent magnet synchronous electric motor with a permanent magnet internally placed.
Figure 16B:
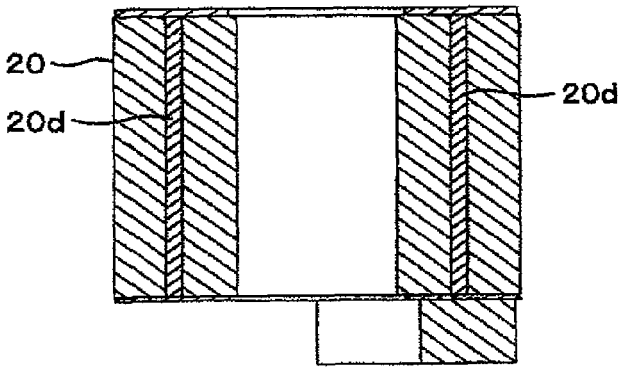

FIGS. 16A and 16B show a structure example of the rotor 20 of the permanent magnet synchronous motor internally provided with a permanent magnet 20*d*, FIG. 16A is a plane view of it, and FIG. 16B is a vertical sectional view. The permanent magnets 20*d* are placed at the four spots in the circumferential direction as shown in FIG. 16A. Reference numeral and character 20*e* denotes the diameter of the circle contacting the inner sides of the four permanent magnets, that is, the diameter of arrangement of the permanent magnets as an inscribed circle diameter of the permanent magnets. The projecting portion 55*e* of the boss portion of the balance weight 55 is constructed to be at the inner side from the diameter 20*e* of arrangement of the aforementioned permanent magnets, whereby even when the balance weight is constructed by iron, the influence given to the magnetic fluxes generated by the permanent magnets 20*d* can be made small.

By constructing the balance weight portion as described in the aforementioned example, a clearance for causing oil to flow out can be provided between the balance weight and the rotor, and through this clearance, the oil which drops to the inside of the balance weight can be discharged to the outer periphery of the upper portion of the rotor. Thereby, input of the compressor can be reduced, the compressor with less power consumption can be obtained, and the oil flowing outside the compressor can be decreased. Therefore, the performance of the refrigeration cycle can be enhanced by reduction in oil churn.

Further, even when the electric motor of the structure in which the permanent magnets are placed inside the rotor is used, leakage of the magnetic fluxes of the rotor can be reduced by adopting the constructions shown in FIGS. 4, 5 and 14, or by using the material other than iron (non-magnetic substance) as the positioning member. Therefore, there is provided the effect of securing the electric motor efficiency and being capable of preventing increase in input of the compressor.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A revolution type compressor configured to compress a refrigerant comprising:

a compressing mechanism configured to compress the refrigerant;

a drive shaft configured to drive the compressing mechanism;

an electric motor configured to rotate the drive shaft;

a hermetically sealed container configured to contain the compressing mechanism, the drive shaft and the electric motor; and a balance weight disposed on the drive shaft to be balanced in rotating mass with the compressing mechanism, the electric motor including a stator fixed to the container and a rotor connected to the drive shaft;

wherein the balance weight includes a magnetic material, and:

a weight portion of semicircular column shape, for balancing the balance weight and the compressing mechanism in rotating mass with each other, a cover portion of semi-cylindrical shape, disposed opposite radially to the weight portion and including openings disposed at lower and upper areas respectively, wherein an outer diameter of the cover portion is substantially the same as an outer diameter of the weight portion, and a hollow space, surrounded by the weight portion and the cover portion;

wherein each of the weight portion and the cover portion is disposed to be axially distant from the rotor such that the entirety of an axial end surface of the balance weight that axially faces the rotor is disposed to be distant from the rotor, such that an axial clearance is formed at least partially between the rotor and the axial end surface of the balance weight that axially faces the rotor; and wherein the hollow space opens to the axial clearance, and the axial clearance extends radially outward to an outer periphery of at least one of the balance weight and the rotor to open to a space in the hermetically sealed container at the outer periphery, wherein the compressor further comprises:

a positioning member disposed in the axial clearance and prevented from extending to close the opening at the lower area of the cover portion.

2. The revolution type compressor according to claim 1, wherein the positioning member has a fluidal path communicating fluidly with the opening at the lower area of the cover portion.

3. The revolution type compressor according to claim 2, wherein the rotor has another fluidal path configured to communicate fluidly at an axial end surface of the rotor facing to the positioning member, with the fluidal path.

4. The revolution type compressor according to claim 2, wherein the rotor includes permanent magnets.

5. The revolution type compressor according to claim 1, wherein the rotor includes permanent magnets, and the positioning member includes a non-magnetic material.

6. The revolution type compressor according to claim 1, wherein the rotor includes permanent magnets, and the positioning member has an outer peripheral diameter less than an inscribed circle diameter of the permanent magnets.

7. A revolution type compressor configured to compress a refrigerant, comprising:

a compressing mechanism configured to compress the refrigerant;

a drive shaft configured to drive the compressing mechanism;

an electric motor configured to rotate the drive shaft;

a hermetically sealed container configured to contain the compressing mechanism, the drive shaft and the electric motor; and a balance weight disposed on the drive shaft to be balanced in rotating mass with the compressing mechanism, the electric motor including a stator fixed to the container and a rotor connected to the drive shaft;

wherein the balance weight has a weight portion of semicircular column shape for balancing the balance weight and the compressing mechanism in rotating mass with each other, and a cover portion of semi-cylindrical shape disposed opposite radially to the weight portion, in order to form a hollow space surrounded by the weight portion and the cover portion and that includes openings disposed at lower and upper areas thereof, respectively; and wherein the compressor further comprises a positioning member comprised of a non-magnetic material, and is disposed between the balance weight and the rotor in order to form an axial clearance between the balance weight and the rotor, and prevented from extending to close the opening at the lower area of the cover portion so that the opening at the lower area of the cover portion communicates with the axial clearance, and the axial clearance extends radially outward to an outer periphery of at least one of the balance weight and the rotor to open to a space in the hermetically sealed container at the outer periphery.

8. The revolution type compressor according to claim 7, wherein the balance weight includes a magnetic material.

9. The revolution type compressor according to claim 7, further comprising:

a boss portion fastened to the drive shaft, wherein a upper end surface of the boss portion is fixed to an lower end surface of a stepped portion of the drive shaft.

* * * * *